US005490668A

United States Patent [19]

Ritch

[11] Patent Number: 5,490,668

[45] Date of Patent: Feb. 13, 1996

[54] FOOTBALL PRACTICE PLACE-KICKING TEE

[75] Inventor: James L. Ritch, Arcadia, Fla.

[73] Assignee: Steve Duke, Port Charlotte, Fla.

[21] Appl. No.: 333,437

[22] Filed: Nov. 2, 1994

[51] Int. Cl.[6] ..... A63B 67/00

[52] U.S. Cl. ..... 273/55 B

[58] Field of Search ..... 273/55 B, 407; 248/68.1, 545, 550, 530, 156

[56] References Cited

U.S. PATENT DOCUMENTS

| | | | |
|---|---|---|---|
| 3,105,686 | 10/1963 | Elsea | 273/55 B |
| 3,194,557 | 7/1965 | Holley | 273/55 B |
| 3,439,916 | 4/1969 | Kopp | 273/55 B |
| 3,462,145 | 8/1969 | Shirley | 273/55 B |
| 3,769,706 | 10/1973 | Cavett | 273/55 B |
| 3,897,948 | 8/1975 | Gerela | 273/55 B |
| 4,718,668 | 1/1988 | Schipske | 273/55 B |

*Primary Examiner*—Theatrice Brown
*Attorney, Agent, or Firm*—Charles J. Prescott

[57] ABSTRACT

An aid for an assisted practicing of football place-kicks. The device is fabricated of economical elements of p.v.c. conduit and fittings. The device includes an elongated upright p.v.c. conduit substantially longer than the length of a football, and connected at one end thereof into a first p.v.c. right angle elbow fitting. A horizontal leg of p.v.c. conduit shorter than the upright leg is also connected at one end thereof into the first elbow fitting. A second right angle elbow fitting is rotatably fitted onto the other end of the horizontal leg so as to freely rotate with respect to the horizontal leg as a kicker's foot strikes the football. This generally inverted L-shaped device is thus structured to have the lower portion of the upright leg embedded into the ground whereby the open end of the second p.v.c. elbow fitting, oriented facing downwardly, supportively engages over the upper end of the football.

2 Claims, 2 Drawing Sheets

FOOTBALL PRACTICE PLACE-KICKING TEE

BACKGROUND OF THE INVENTION

1. Scope of Invention

This invention is generally related to sports practice devices, and more particularly to a practice device for holding a football for place-kicking.

2. Prior Art

Place-kicking of a football occurs on at least three occasions during a football game. The first occasion for place-kicking is when the football game is commenced at the starting kickoff and after each team has scored points requiring an additional kick-off. The third occasion is in an attempt to kick a field goal in lieu of attempting to achieve a touchdown. Thus, effective place-kicking by at least one football team member is of utmost importance to achieve an overall balanced football offensive.

During the game kick-offs, the football generally rests in what is known as a football tee. This football tee rests atop the ground and includes upwardly extending structure which supports the football in a generally upright position in self-supported fashion. However, in attempting to kick a field goal, the football is generally snapped to another team member who receives the football and then quickly places one end of the football on the ground in upright fashion, holding the upper end of the football stationary by finger contact ready for being struck by the place kicker.

Obviously, then, expertise in football place-kicking is of utmost importance and extensive practice is required. Utilization of the football tee will facilitate kickoff practice. However, applicant is unaware of any effective substitute for requiring a separate person to finger hold the football atop the ground in upright kicking position.

The present invention provides a practice device for holding a football in upright position atop the ground or atop an additional place-kicking pad without the aid of any other individual. Thus, the invention provides a completely self-supporting arrangement for holding the football ready for place-kicking and includes structural features which will not place any obstruction into the path of the kicker's foot or leg.

BRIEF SUMMARY OF THE INVENTION

This invention is directed to an aid for unassisted practicing of football place-kicks. The device is fabricated of economical elements of p.v.c. conduit and fittings. The device includes an elongated upright p.v.c. conduit substantially longer than the length of a football, and connected at one end thereof into a first p.v.c. right angle elbow fitting. A horizontal leg of p.v.c. conduit shorter than the upright leg is also connected at one end thereof into the first elbow fitting. A second right angle elbow fitting is rotatably fitted onto the other end of the horizontal leg so as to freely rotate with respect to the horizontal leg as a kicker's foot strikes the football. This generally inverted L-shaped device is thus structured to have the lower portion of the upright leg embedded into the ground whereby the open end of the second p.v.c. elbow fitting, oriented facing downwardly, supportively engages over the upper end of the football.

It is therefore an object of this invention to provide a football place kicking practice device which facilitates unassisted holding of the football in position for practicing place kicks.

It is yet another object of this invention to provide an economical to manufacture football holding device for practicing place kicks fabricated of p.v.c. conduit and fittings.

It is yet another object of this invention to provide a device for holding a football for practicing which will not otherwise interfere with the path of the kicker's foot or leg during practice.

It is yet another object of this invention to provide a football place-kicking practice device which will readily adapt in height to accommodate either off-grass or off-pad practice place kicking.

In accordance with these and other objects which will become apparent hereinafter, the instant invention will now be described with reference to the accompanying drawings.

DETAILED DESCRIPTION OF THE INVENTION

Figure 1:
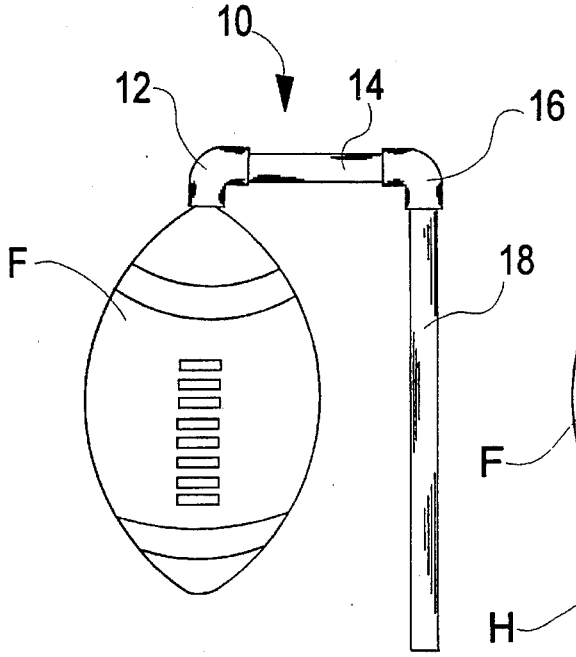
FIG. 1 is a front perspective view of the invention in use holding a football atop the grass.
Figure 2:
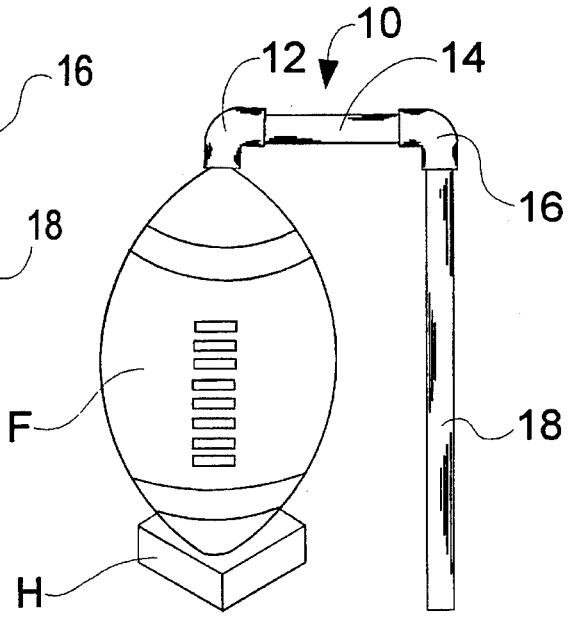
FIG. 2 is a front perspective view similar to FIG. 1 with the football positioned atop a place kicking pad.
Figure 3:
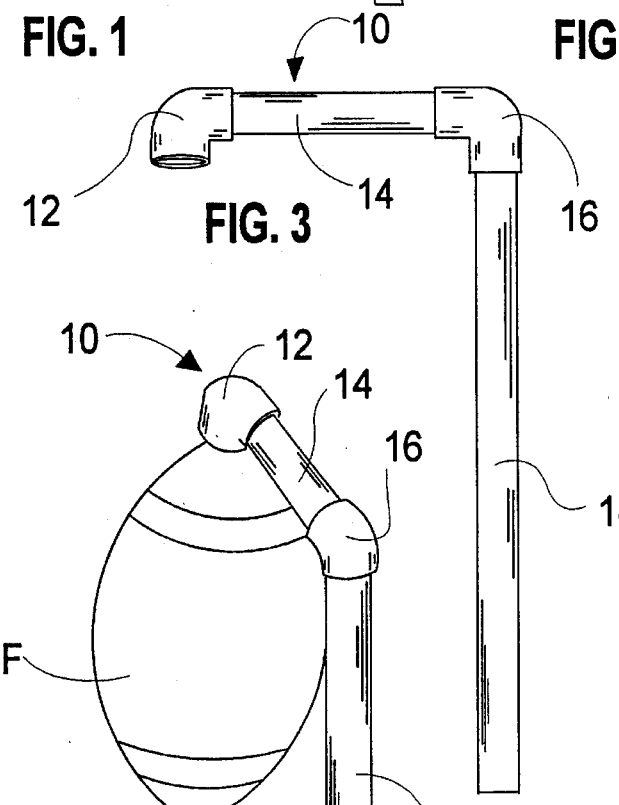
FIG. 3 is a side elevation view of the invention.
Figure 4:
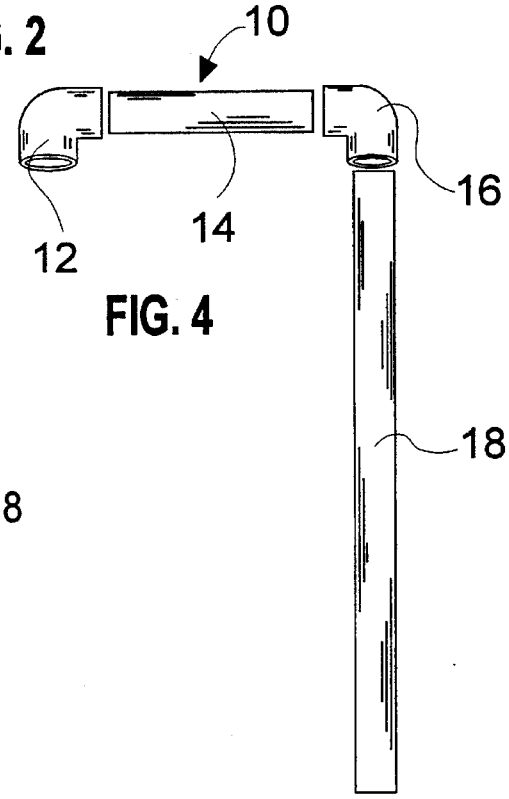
FIG. 4 is a side elevation exploded view of the invention.
Figure 5:
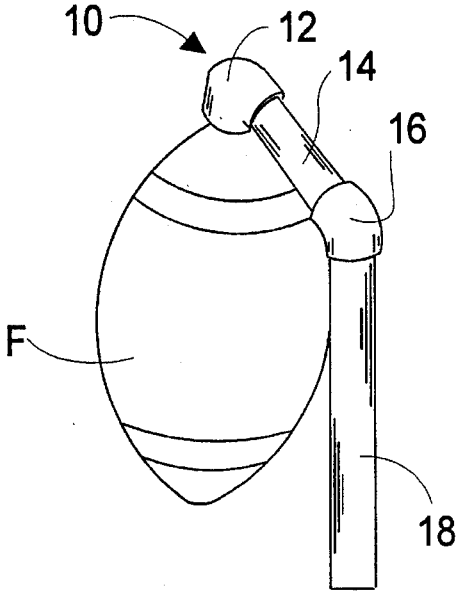
FIG. 5 is a side perspective view of FIG. 1.

Referring now to the drawings, the invention is shown generally at numeral 10 having a generally inverted L-shape and including an upright leg 18 formed of a length of polyvinyl chloride (p.v.c.) tubular conduit and a horizontally extending leg 14 also formed of p.v.c tubular conduit. These two legs 14 and 18 are rigidly interconnected by a right angle elbow fitting 16 also formed of p.v.c. A second right angle elbow fitting 12 is also provided having a slip fit onto the opposite end of horizontal leg 14 for relatively free rotation of the second elbow fitting 12.

In use as best seen in FIGS. 1, 2, 5, and 6, the upright leg 18 is embedded into the ground a distance sufficient to completely stabilize the device 10. As a result, upright leg 18 has a length substantially greater than the length of football F.

Upright leg 18 is thus buried manually into the ground in upright orientation so that the downwardly facing open end of the second elbow fitting 12 presses against and supports the upper end of the football F. To facilitate this retention arrangement, the diameter of the downwardly facing unconnected open end of second elbow 12 is sufficient so as to adequately engage the upper end of the football F as shown.

Figure 6:
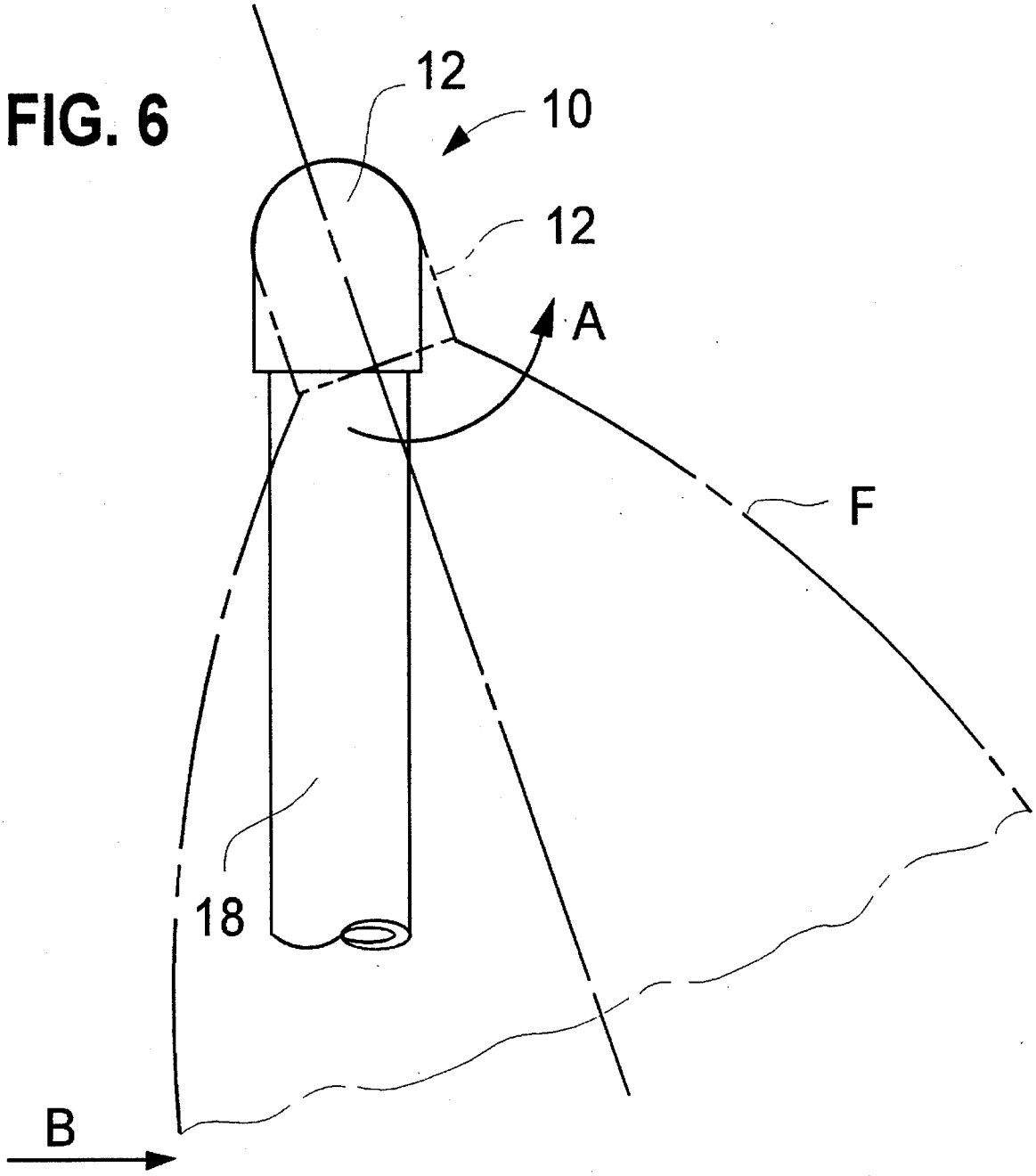
FIG. 6 is an enlarged schematic view of the upper portion of the invention showing a football in position in phantom with respect thereto.

As best seen in FIG. 6, when the football F shown in phantom is struck in the direction of arrow B by the foot of the kicker, the second elbow 12 will rotate with respect to the horizontal leg 14 in the direction of the arrow. This prevents virtually any interference with the flight of the football F after being kicked. Additionally, the entire device 10 will easily rotate in the ground with respect to the longitudinal axis of upright leg 18 with very light leg or foot contact so as to completely eliminate any interference with the kicker's foot or lower leg.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A football practice place-kicking tee for holding an American football in a substantially upright position for practice kicking, comprising:

an inverted substantially L-shaped member, said member having first and second elongated leg sections and each leg section having first and second ends, said first end of said first leg section being rigidly connected to said first end of said second leg section by a right angle (90°) elbow connector member;

a second right angle (90°) elbow being rotatably connected to said second end of said first leg section and being freely rotatable thereon;

said second leg section having a length substantially greater than the length of an American football and said second end thereof being loosely insertable into the ground to thereby place said second leg section substantially vertical and said first leg section substantially horizontal and spaced from the ground;

said second elbow, having a downwardly facing open free end for engaging the upper end of an American football when held upright by said L-shaped member, will freely rotate on said second end of said first leg and said second leg will rotate about its longitudinal axis.

2. A football practice kicking aid as defined in claim 1, wherein: said L-shaped member first and second sections and said first and second elbows are formed form tubular P.V.C. material.

* * * * *